US012448105B2

(12) United States Patent
Shirao et al.

(10) Patent No.: US 12,448,105 B2
(45) Date of Patent: Oct. 21, 2025

(54) AUTOMATIC WATERCRAFT MANEUVERING SYSTEM, WATERCRAFT CONTROL DEVICE, WATERCRAFT CONTROL METHOD, AND RECORDING MEDIUM

(71) Applicants: NHK SPRING Co., Ltd., Yokohama (JP); YAMAHA HATSUDOKI KABUSHIKI KAISHA, Iwata (JP)

(72) Inventors: Masato Shirao, Yokohama (JP); Marino Akita, Yokohama (JP); Takafumi Kamiya, Yokohama (JP); Yukitaka Okamoto, Iwata (JP); Takuya Murayama, Iwata (JP)

(73) Assignees: NHK SPRING CO., LTD., Kanagawa (JP); YAMAHA HATSUDOKI KABUSHIKI KAISHA, Iwata (JP)

( * ) Notice: Subject to any disclaimer, the term of this patent is extended or adjusted under 35 U.S.C. 154(b) by 616 days.

(21) Appl. No.: 17/832,807

(22) Filed: Jun. 6, 2022

(65) Prior Publication Data

US 2022/0396345 A1 Dec. 15, 2022

(30) Foreign Application Priority Data

Jun. 10, 2021 (JP) ..... 2021-097231

(51) Int. Cl.
*B63H 25/04* (2006.01)
*B63C 9/00* (2006.01)

(52) U.S. Cl.
CPC ..... *B63H 25/04* (2013.01); *B63C 9/0005* (2013.01)

(58) Field of Classification Search
CPC ..... B63H 25/00; B63H 25/02; B63H 25/04; B63C 9/00; B63C 9/0005
USPC ..... 114/144 R
See application file for complete search history.

(56) References Cited

U.S. PATENT DOCUMENTS

| | | | | |
|---|---|---|---|---|
| 4,305,143 | A | 12/1981 | Simms et al. | |
| 10,921,802 | B2 * | 2/2021 | Bertrand | B63H 25/02 |
| 2018/0335780 | A1 | 11/2018 | Stevens et al. | |

FOREIGN PATENT DOCUMENTS

| | | | |
|---|---|---|---|
| JP | H04185597 | A | 7/1992 |
| JP | H05131990 | A | 5/1993 |
| JP | 2000006891 | A | 1/2000 |
| JP | 2003127987 | A | 5/2003 |

OTHER PUBLICATIONS

JPO Notice of Reasons for Refusal for corresponding JP Application No. 2021-097231; Issued Oct. 1, 2024.

* cited by examiner

*Primary Examiner* — Lars A Olson
(74) *Attorney, Agent, or Firm* — CANTOR COLBURN LLP

(57) ABSTRACT

An automatic watercraft maneuvering system includes a watercraft and a communication device.

5 Claims, 8 Drawing Sheets

AUTOMATIC WATERCRAFT MANEUVERING SYSTEM, WATERCRAFT CONTROL DEVICE, WATERCRAFT CONTROL METHOD, AND RECORDING MEDIUM

CROSS-REFERENCE TO RELATED APPLICATION

The present invention claims priority under 35 U.S.C. § 119 to Japanese Patent Application 2021-097231, filed Jun. 10, 2021, the entire contents of which being incorporated herein by reference.

BACKGROUND THE INVENTION

Field of the Invention

The present disclosure relates to an automatic watercraft maneuvering system, a watercraft control device, a watercraft control method, and a recording medium.

DESCRIPTION OF RELATED ART

A personal watercraft (PWC) automatic return system is known (for example, see Patent Document 1). The PWC automatic return system described in Patent Document 1 includes a user device and an autopilot unit that is provided in a PWC. The user device includes a rider location determination unit, a user interface, and a communication unit. In the technique described in Patent Document 1, when a rider carrying a user device falls off a PWC (falls into water), the PWC receives an instruction from the user interface and moves to a position of the user device by automated return to rider functionality.

Patent Document 1 does not describe a speed of a PWC when automated return to rider functionality is performed. When a speed of a PWC is not appropriately controlled in automated return to rider functionality, the PWC may not be appropriately moved to a position of the fallen rider carrying the user device.

[Patent Document 1] United States Patent Application, Publication No. 2018/0335780

SUMMARY OF THE INVENTION

In consideration of the aforementioned problems, an objective of the present disclosure is to provide an automatic watercraft maneuvering system, a watercraft control device, a watercraft control method, and a recording medium that can appropriately control a speed of a watercraft in response to a request from an operator of a communication device in an automatic watercraft maneuvering mode.

According to an aspect of the present disclosure, there is provided an automatic watercraft maneuvering system including a watercraft and a communication device, wherein the watercraft includes: an actuator having a function of generating thrust of the watercraft and a function as a steering unit; a first operation unit configured to receive an input operation of operating the actuator; and a watercraft control device configured to operate the actuator on the basis of at least the input operation received by the first operation unit, wherein the watercraft control device includes a manual watercraft maneuvering mode in which the watercraft control device operates the actuator on the basis of the input operation received by the first operation unit and an automatic watercraft maneuvering mode in which the watercraft control device operates the actuator without the need for the first operation unit to receive an input operation, wherein the communication device includes a second operation unit configured to receive an input operation of operating the actuator, and wherein the watercraft control device controls a speed of the watercraft on the basis of the input operation received by the second operation unit when the watercraft control device operates the actuator to make the watercraft approach the communication device in the automatic watercraft maneuvering mode.

According to another aspect of the present disclosure, there is provided a watercraft control device provided in a watercraft, the watercraft including; an actuator having a function of generating thrust of the watercraft and a function as a steering unit; and a first operation unit configured to receive an input operation of operating the actuator, wherein the watercraft control device includes a manual watercraft maneuvering mode in which the watercraft control device operates the actuator on the basis of the input operation received by the first operation unit and an automatic watercraft maneuvering mode in which the watercraft control device operates the actuator without the need for the first operation unit to receive an input operation, and wherein the watercraft control device controls a speed of the watercraft on the basis of an input operation received by a second operation unit provided in a communication device when the watercraft control device operates the actuator to make the watercraft approach the communication device in the automatic watercraft maneuvering mode.

According to another aspect of the present disclosure, there is provided a watercraft control method of controlling a watercraft including an actuator having a function of generating thrust of the watercraft and a function as a steering unit and a first operation unit configured to receive an input operation of operating the actuator, the watercraft control method including a watercraft control step of operating the actuator on the basis of at least the input operation received by the first operation unit, wherein the watercraft control step includes a manual watercraft maneuvering step of operating the actuator on the basis of the input operation received by the first operation unit and an automatic watercraft maneuvering step of operating the actuator without the need for the first operation unit to receive an input operation, and wherein the automatic watercraft maneuvering step includes controlling a speed of the watercraft on the basis of an input operation received by a second operation unit provided in a communication device when the watercraft control device operates the actuator to make the watercraft approach the communication device.

According to another aspect of the present disclosure, there is provided a computer-readable recording medium storing a program causing a computer mounted in a watercraft to perform a watercraft control step of operating an actuator on the basis of at least an input operation received by a first operation unit, the watercraft including the actuator having a function of generating thrust of the watercraft and a function as a steering unit and the first operation unit configured to receive the input operation of operating the actuator, wherein the watercraft control step includes a manual watercraft maneuvering step of operating the actuator on the basis of the input operation received by the first operation unit and an automatic watercraft maneuvering step of operating the actuator without the need for the first operation unit to receive an input operation, and wherein the automatic watercraft maneuvering step includes controlling a speed of the watercraft on the basis of an input operation received by a second operation unit provided in a communication device when the actuator is operated to make the watercraft approach the communication device.

According to the present disclosure, it is possible to provide an automatic watercraft maneuvering system, a watercraft control device, a watercraft control method, and a recording medium that can appropriately control a speed of a watercraft in response to a request from an operator of a communication device in an automatic watercraft maneuvering mode.

DETAILED DESCRIPTION OF THE INVENTION

First Embodiment

Hereinafter, an automatic watercraft maneuvering system, a watercraft control device, a watercraft control method, and a recording medium according to a first embodiment of the present disclosure.

Figure 1:
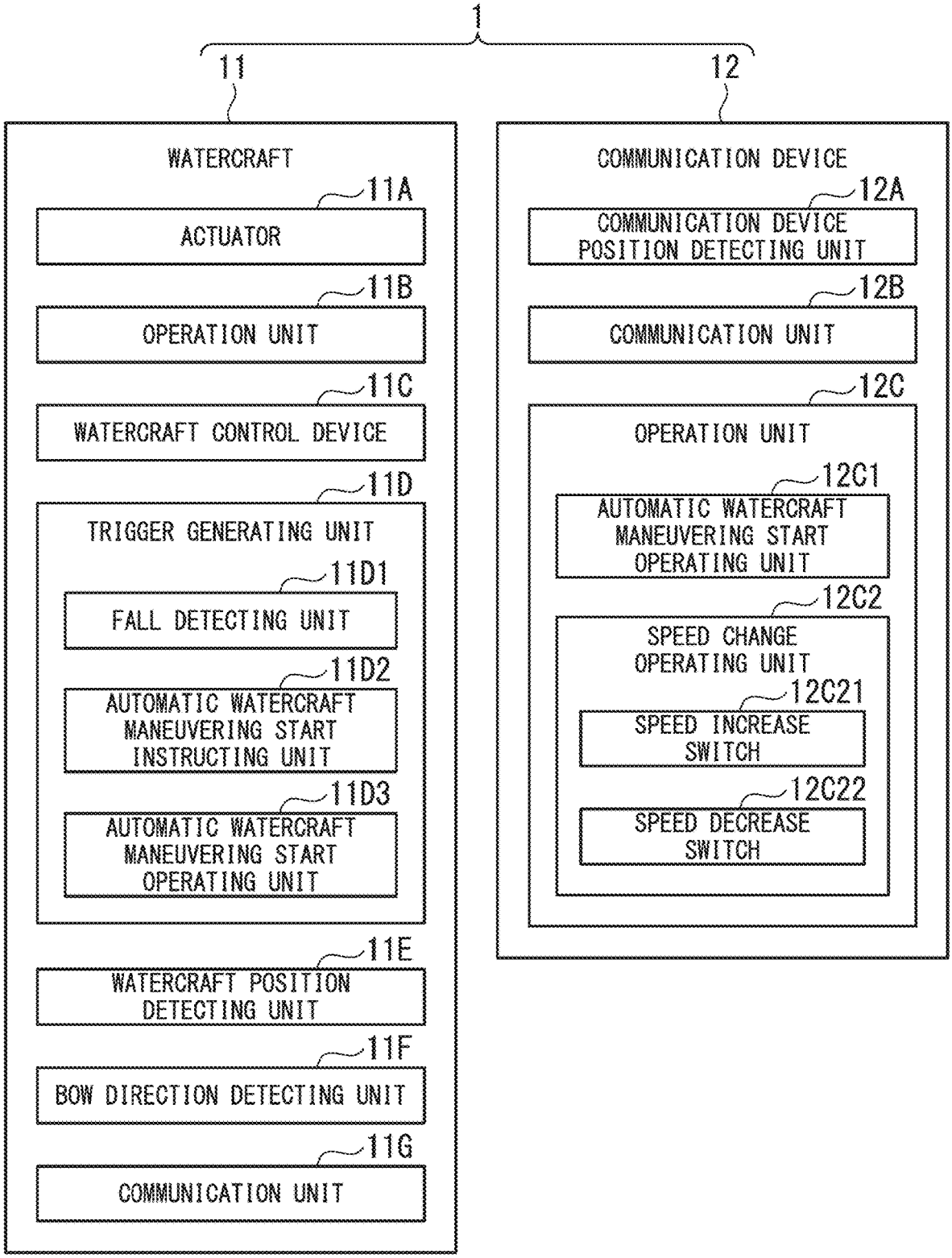
FIG. 1 is a diagram schematically showing an example of an automatic watercraft maneuvering system according to a first embodiment.

FIG. 1 is a diagram schematically showing an example of an automatic watercraft maneuvering system 1 according to the first embodiment.

In the example shown in FIG. 1, the automatic watercraft maneuvering system 1 includes a watercraft 11 and a communication device 12.

The watercraft 11 according to the first embodiment is, for example, a personal watercraft (PWC) with the same function that a PWC (water-motorcycle) described in FIG. 1 of Japanese Patent No. 5196649 has. The watercraft 11 includes an actuator 11A, an operation unit 11B, a watercraft control device 11C, a trigger generating unit 11D, a watercraft position detecting unit 11E, a head direction detecting unit 11F, and a communication unit 11G.

The actuator 11A has a function of generating thrust of the watercraft 11 and a function as a steering unit. The actuator 11A includes, for example, an engine, a nozzle, a deflector, a trim actuator, a bucket, a bucket actuator, etc., described in FIG. 1 of Japanese Unexamined Patent Application, First Publication No. 2019-171925.

The operation unit 11B receives an input operation of operating the actuator 11A from a watercraft operator. The operation unit 11B is configured in the same way as, for example, a steering wheel described in FIG. 1 of Japanese Patent No. 5196649, a steering unit described in FIG. 1 Japanese Unexamined Patent Application, First Publication No. 2019-171925, etc.

The watercraft control device 11C performs control for operating the actuator 11A on the basis of the input operation from the operator received by the operation unit 11B, or the like. The watercraft control device 11C includes a manual watercraft maneuvering mode in which the watercraft control device 11C operates the actuator 11A on the basis of the input operation from the operator received by the operation unit 11B and an automatic watercraft maneuvering mode in which the watercraft control device 11C operates the actuator 11A without the need for the operation unit 11B to receive an input operation.

The trigger generating unit 11D generates a trigger for switching the watercraft control device 11C from the manual watercraft maneuvering mode to the automatic watercraft maneuvering mode. The trigger generating unit 11D includes a fall detecting unit 11D1, an automatic watercraft maneuvering start instructing unit 11D2, and an automatic watercraft maneuvering start operating unit 11D3.

The fall detecting unit 11D1 detects a fall of a passenger (for example, an operator or a passenger other than an operator) of the watercraft 11. The fall detecting unit 11D1 according to the first embodiment is configured in the same way as a lanyard cord and a switch described in Paragraph 0002 of Japanese Patent No. 4205261, for example. Specifically, one end of the lanyard cord is connected to a subject (for example, an operator or a passenger other than an operator) whose fall is to be detected. The other end of the lanyard cord is connected to a switch (not shown) disposed in the watercraft 11.

When the subject to be detected fell off the watercraft 11, the other end of the lanyard cord disconnects from the switch, and the switch detects a fall of the subject to be detected.

The automatic watercraft maneuvering start instructing unit 11D2 outputs an automatic watercraft maneuvering start instruction on the basis of an automatic watercraft maneuvering start request transmitted from the communication device 12 or an automatic watercraft maneuvering start request from an operator of the watercraft 11. The automatic watercraft maneuvering start operating unit 11D3 receives the automatic watercraft maneuvering start request from the operator of the watercraft 11 (specifically an automatic watercraft maneuvering start request from an operator in the watercraft).

The automatic watercraft maneuvering start instruction output by the automatic watercraft maneuvering start instructing unit 11D2 serves as a trigger for switching the watercraft control device 11C from the manual watercraft maneuvering mode to the automatic watercraft maneuvering mode. That is, when the automatic watercraft maneuvering start instructing unit 11D2 outputs the automatic watercraft maneuvering start instruction, the watercraft control device 11C switches from the manual watercraft maneuvering mode to the automatic watercraft maneuvering mode in which the watercraft control device 11C operates the actuator 11A without the need for the operation unit 11B to receive an input operation. The watercraft control device 11C controls the actuator 11A, for example, on the basis of a position of the watercraft 11, a position of the communication device 12, and a head direction of the watercraft 11 in the automatic watercraft maneuvering mode.

In another example, the trigger generating unit 11D may not include the automatic watercraft maneuvering start instructing unit 11D2. In this example, when the fall detecting unit 11D1 detects a fall of a passenger of the watercraft 11, the trigger generating unit 11D generates a trigger, and the watercraft control device 11C switches from the manual watercraft maneuvering mode to the automatic watercraft maneuvering mode.

In the example shown in FIG. 1, the watercraft position detecting unit 11E detects a position of the watercraft 11. The watercraft position detecting unit 11E includes, for example, a Global Positioning System (GPS) unit. The GPS unit calculates positional coordinates of the watercraft 11 by receiving signals from a plurality of GPS satellites. The position of the watercraft 11 detected by the watercraft position detecting unit 11E is used for control in the automatic watercraft maneuvering mode of the watercraft control device 11C.

The head direction detecting unit 11F detects a head direction of the watercraft 11. The head direction detecting unit 11F includes, for example, a direction sensor. The direction sensor calculates the head direction of the watercraft 11, for example, using geomagnetism. The head direction of the watercraft 11 detected by the head direction detecting unit 11F is used for control in the automatic watercraft maneuvering mode of the watercraft control device 11C.

In another example, the direction sensor may be a device (a gyrocompass) in which a north indicator and a vibration control device are added to a gyroscope rotating fast and which normally indicates north.

In another example, the direction sensor may be a GPS compass that includes a plurality of GPS antennas and calculates the head direction from a relative positional relationship among the plurality of GPS antennas.

In the example shown in FIG. 1, the communication unit 11G communicates with the communication device 12.

The communication device 12 is carried by the subject to be detected (the passenger). The communication device 12 includes a communication device position detecting unit 12A, a communication unit 12B, and an operation unit 12C. The communication device position detecting unit 12A detects a position of the communication device 12. The communication device position detecting unit 12A includes, for example, a GPS unit. The GPS unit calculates positional coordinates of the communication device 12 by receiving signals from a plurality of GPS satellites.

The operation unit 12C receives, for example, an input operation from the operator of the watercraft 11 (for example, an input operation from the operator who carries the communication device 12 and fell off the watercraft 11). Specifically, the operation unit 12C receives an input operation or the like of operating the actuator 11A of the watercraft 11 in the automatic watercraft maneuvering mode of the watercraft control device 11C. The operation unit 12C includes an automatic watercraft maneuvering start operating unit 12C1 and a speed change operating unit 12C2.

The automatic watercraft maneuvering start operating unit 12C1 receives an automatic watercraft maneuvering start request from, for example, the operator of the watercraft 11 (an automatic watercraft maneuvering start request from, for example, the operator who carries the communication device 12 and fell off the watercraft 11).

The speed change operating unit 12C2 receives an input operation of changing a speed of the watercraft 11 in the automatic watercraft maneuvering mode of the watercraft control device 11C. The speed change operating unit 12C2 includes a speed increase switch 12C21 and a speed decrease switch 12C22. The speed increase switch 12C21 receives an input operation of increasing the speed of the watercraft 11 in the automatic watercraft maneuvering mode of the watercraft control device 11C. The speed decrease switch 12C22 receives an input operation of decreasing the speed of the watercraft 11 in the automatic watercraft maneuvering mode of the watercraft control device 11C.

In the example shown in FIG. 1, the speed of the watercraft 11 is increased by a predetermined value when the input operation to the speed increase switch 12C21 is performed once, and the speed of the watercraft 11 is increased by N times the predetermined value when the input operation to the speed increase switch 12C21 is performed N times. The speed of the watercraft 11 is decreased by a predetermined value when the input operation to the speed decrease switch 12C22 is performed once, and the speed of the watercraft 11 is decreased by N times the predetermined value when the input operation to the speed decrease switch 12C22 is performed N times.

That is, in the example shown in FIG. 1, the speed of the watercraft 11 is increased or decreased stepwise.

In another example, the speed of the watercraft 11 may be increased by a speed increase amount which is proportional to an input operation time to the speed increase switch 12C21 (for example, a pressing time of the speed increase switch 12C21), and the speed of the watercraft 11 may be decreased by a speed decrease amount which is proportional to an input operation time to the speed decrease switch 12C22 (for example, a pressing time of the speed decrease switch 12C22).

That is, in this example, the speed of the watercraft 11 is increased or decreased stepless (linearly).

In another example, the speed change operating unit 12C2 may not include the speed decrease switch 12C22 but may include only the speed increase switch 12C21. In this example, the speed of the watercraft 11 is increased (that is, becomes higher) while an input operation to the speed increase switch 12C21 is performed, and the speed of the watercraft 11 is decreased (that is, becomes lower) while an input operation to the speed increase switch 12C21 is not performed.

In another example, the speed change operating unit 12C2 may include only a speed changeover switch (not shown). In this example, whenever an input operation to the speed changeover switch is performed, the setting switches between a low speed and a high speed. For example, by default (that is, when no input operation to the speed switch has been performed), the speed of the watercraft 11 is low.

In another example, the speed change operating unit 12C2 may include the speed increase switch 12C21, the speed decrease switch 12C22, and a stop switch (not shown). In this example, when an input operation to the stop switch is performed, the watercraft 11 can be stopped more quickly than when an input operation to the speed decrease switch 12C22 is performed.

In the example shown in FIG. 1, the communication unit 12B transmits information indicating the position of the communication device 12 detected by the communication device position detecting unit 12A to the watercraft 11. The communication unit 11G of the watercraft 11 receives the information indicating the position of the communication device 12 transmitted by the communication unit 12B. The position of the communication device 12 detected by the communication device position detecting unit 12A is used for control in the automatic watercraft maneuvering mode of the watercraft control device 11C.

The communication unit 12B transmits the automatic watercraft maneuvering start request received by the automatic watercraft maneuvering start operating unit 12C1 of the operation unit 12C to the watercraft 11. The communication unit 11G of the watercraft 11 receives the automatic watercraft maneuvering start request transmitted by the communication unit 12B. As described above, the automatic watercraft maneuvering start instructing unit 11D2 of the watercraft 11 outputs an automatic watercraft maneuvering start instruction on the basis of the automatic watercraft maneuvering start request transmitted from the communication device 12.

The communication unit 12B transmits a speed change request (specifically, a speed increase request or a speed decrease request) of the watercraft 11 corresponding to the input operation received by the speed change operating unit 12C2 of the operation unit 12C to the watercraft 11. The communication unit 11G of the watercraft 11 receives the speed change request of the watercraft 11 transmitted by the communication unit 12B. The watercraft control device 11C controls the speed of the watercraft 11 on the basis of the speed change request transmitted from the communication device 12. That is, the watercraft control device 11C controls the speed of the watercraft 11 on the basis of the input operation received by the speed change operating unit 12C2 of the communication device 12.

Figure 2A:
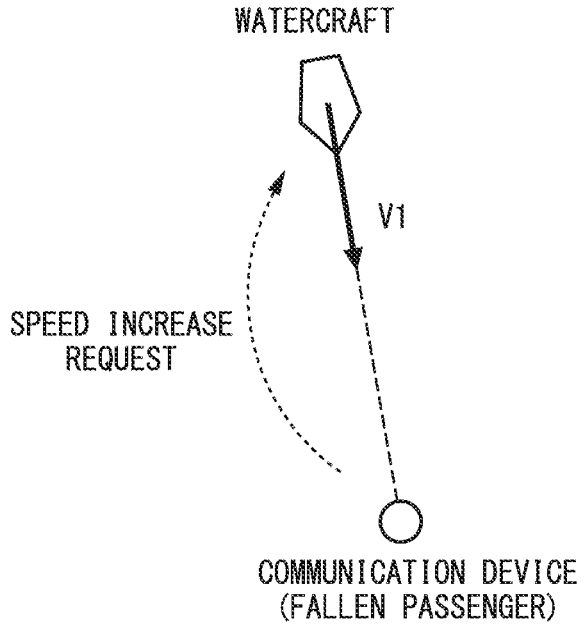
FIG. 2A and FIG. 2B are diagrams explaining an example of a control in an automatic watercraft maneuvering mode of a watercraft control device of the automatic watercraft maneuvering system according to the first embodiment when an automatic watercraft maneuvering start request from a fallen passenger who carries a communication device and fell off a watercraft is transmitted from the communication device to the watercraft.
Figure 2B:
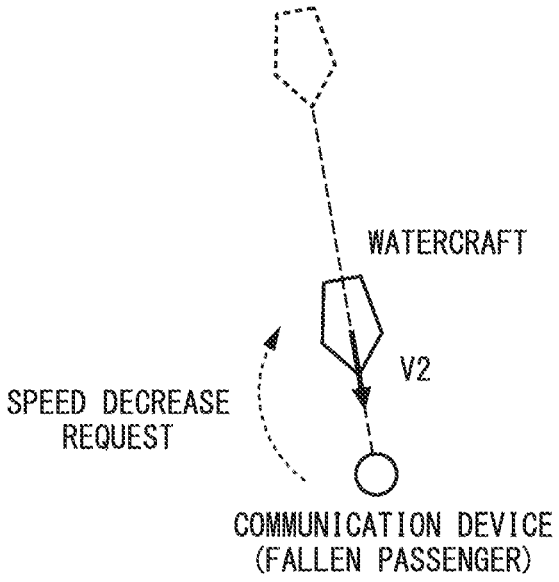

FIG. 2A and FIG. 2B are diagrams explaining an example of a control in the automatic watercraft maneuvering mode of the watercraft control device 11C of the automatic watercraft maneuvering system 1 according to the first embodiment when an automatic watercraft maneuvering start request from a fallen passenger who carries the communication device 12 and fell off the watercraft 11 is transmitted from the communication device 12 to the watercraft 11.

In the example shown in FIG. 2A and FIG. 2B, for example, the operator of the watercraft 11 falls off the watercraft 11 while carrying the communication device 12. Then, the fallen passenger (operator) performs an operation of making the watercraft 11 away from the position of the fallen passenger approach the position of the fallen passenger.

Specifically, the automatic watercraft maneuvering start operating unit 12C1 of the communication device 12 receives an automatic watercraft maneuvering start request from the fallen passenger. The automatic watercraft maneuvering start request from the fallen passenger is transmitted to the watercraft 11 by the communication unit 12B of the communication device 12, and the automatic watercraft maneuvering start instructing unit 11D2 of the watercraft 11 outputs an automatic watercraft maneuvering start instruction on the basis of the automatic watercraft maneuvering start request transmitted from the communication device 12. As a result, the watercraft control device 11C switches from the manual watercraft maneuvering mode to the automatic watercraft maneuvering mode, and the watercraft control device 11C starts control of the actuator 11A based on the position of the watercraft 11, the position of the communication device 12, and the head direction of the watercraft 11. That is, the watercraft control device 11C starts control for operating the actuator 11A to make the watercraft 11 approach the communication device 12.

As shown in FIG. 2A, in a state in which the watercraft 11 is away from the communication device 12 (the fallen passenger), the fallen passenger performs an operation of making the watercraft 11 approach the position of the fallen passenger quickly.

Specifically, the speed increase switch 12C21 of the communication device 12 receives an input operation of increasing the speed of the watercraft 11 from the fallen passenger. The speed increase request from the fallen passenger is transmitted to the watercraft 11 by the communication unit 12B of the communication device 12, and the watercraft control device 11C increases the speed of the watercraft 11 on the basis of the speed increase request from the fallen passenger. In the example shown in FIG. 2A, the watercraft control device 11C increases the speed of the watercraft 11 to V1.

When the watercraft 11 approaches the communication device 12 (the fallen passenger) as shown in FIG. 2B, the fallen passenger performs an operation of decelerating or stopping the watercraft 11.

Specifically, the speed decrease switch 12C22 of the communication device 12 receives an input operation of decreasing the speed of the watercraft 11 from the fallen passenger. The speed decrease request from the fallen passenger is transmitted to the watercraft 11 by the communication unit 12B of the communication device 12, and the watercraft control device 11C decreases the speed of the watercraft 11 on the basis of the speed decrease request from the fallen passenger. In the example shown in FIG. 2B, the watercraft control device 11C decreases the speed of the watercraft 11 from V1 to V2 (≈0).

That is, in the automatic watercraft maneuvering system 1 according to the first embodiment as shown in FIG. 2A and FIG. 2B, when the watercraft control device 11C operates the actuator 11A to make the watercraft 11 approach the communication device 12 in the automatic watercraft maneuvering mode, the watercraft control device 11C of the watercraft 11 controls the speed of the watercraft 11 on the basis of the input operation received by the speed increase switch 12C21 or the speed decrease switch 12C22 of the operation unit 12C of the communication device 12.

Accordingly, in the automatic watercraft maneuvering system 1 according to the first embodiment, it is possible to appropriately control the speed of the watercraft 11 in response to a request from an operator of the communication device 12 (a fallen passenger) in the automatic watercraft maneuvering mode.

In the example shown in FIG. 2A and FIG. 2B, the speed of the watercraft 11 is increased to V1 as described above. In another example, the watercraft 11 or the communication device 12 may have a function of setting a maximum speed of the watercraft 11 in the automatic watercraft maneuvering mode.

Figure 3:
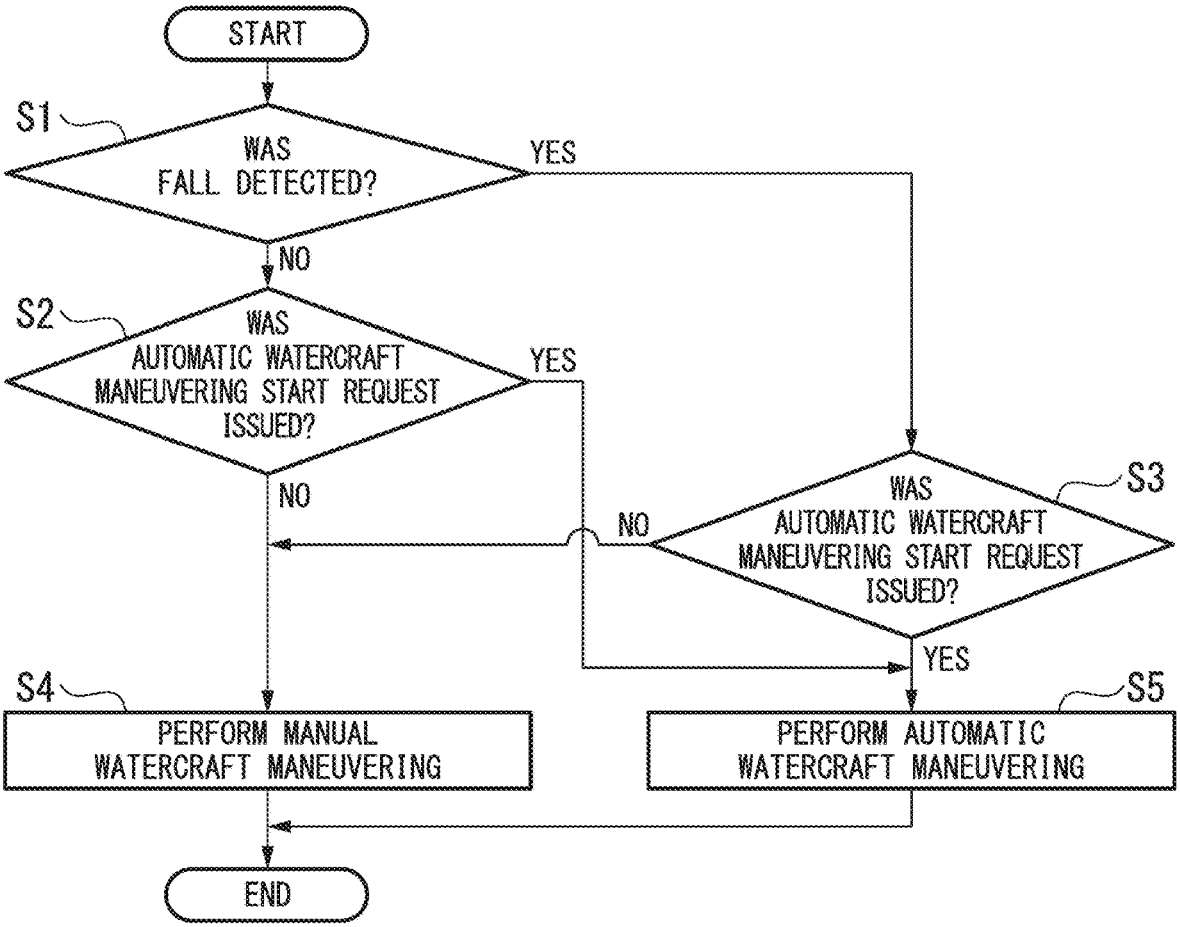
FIG. 3 is a flowchart explaining an example of a process which is performed to switch between a manual watercraft maneuvering mode and an automatic watercraft maneuvering mode by a watercraft control device of the automatic watercraft maneuvering system according to the first embodiment.

FIG. 3 is a flowchart explaining an example of a process which is performed to switch between the manual watercraft maneuvering mode and the automatic watercraft maneuvering mode by the watercraft control device 11C of the automatic watercraft maneuvering system 1 according to the first embodiment.

In the example shown in FIG. 3, in Step S1, for example, the watercraft control device 11C determines whether the fall detecting unit 11D1 detected a fall. When the fall detecting unit 11D1 did not detect a fall, the routine proceeds to Step S2. On the other hand, when the fall detecting unit 11D1 detected a fall, the routine proceeds to Step S3.

In Step S2, for example, the watercraft control device 11C determines whether the automatic watercraft maneuvering start operating unit 11D3 received an automatic watercraft maneuvering start request. When the automatic watercraft maneuvering start operating unit 11D3 did not receive an automatic watercraft maneuvering start request, the routine proceeds to Step S4. On the other hand, when the automatic watercraft maneuvering start operating unit 11D3 received an automatic watercraft maneuvering start request, the routine proceeds to Step S5.

In Step S3, for example, the watercraft control device 11C determines whether the automatic watercraft maneuvering start operating unit 12C1 of the communication device 12 received an automatic watercraft maneuvering start request. When the automatic watercraft maneuvering start operating unit 12C1 did not receive an automatic watercraft maneuvering start request, the routine proceeds to Step S4. On the other hand, when the automatic watercraft maneuvering start operating unit 12C1 received an automatic watercraft maneuvering start request, the routine proceeds to Step S5.

In Step S4, the watercraft control device 11C switches to the manual watercraft maneuvering mode.

In Step S5, the watercraft control device 11C switches to the automatic watercraft maneuvering mode.

Figure 4:
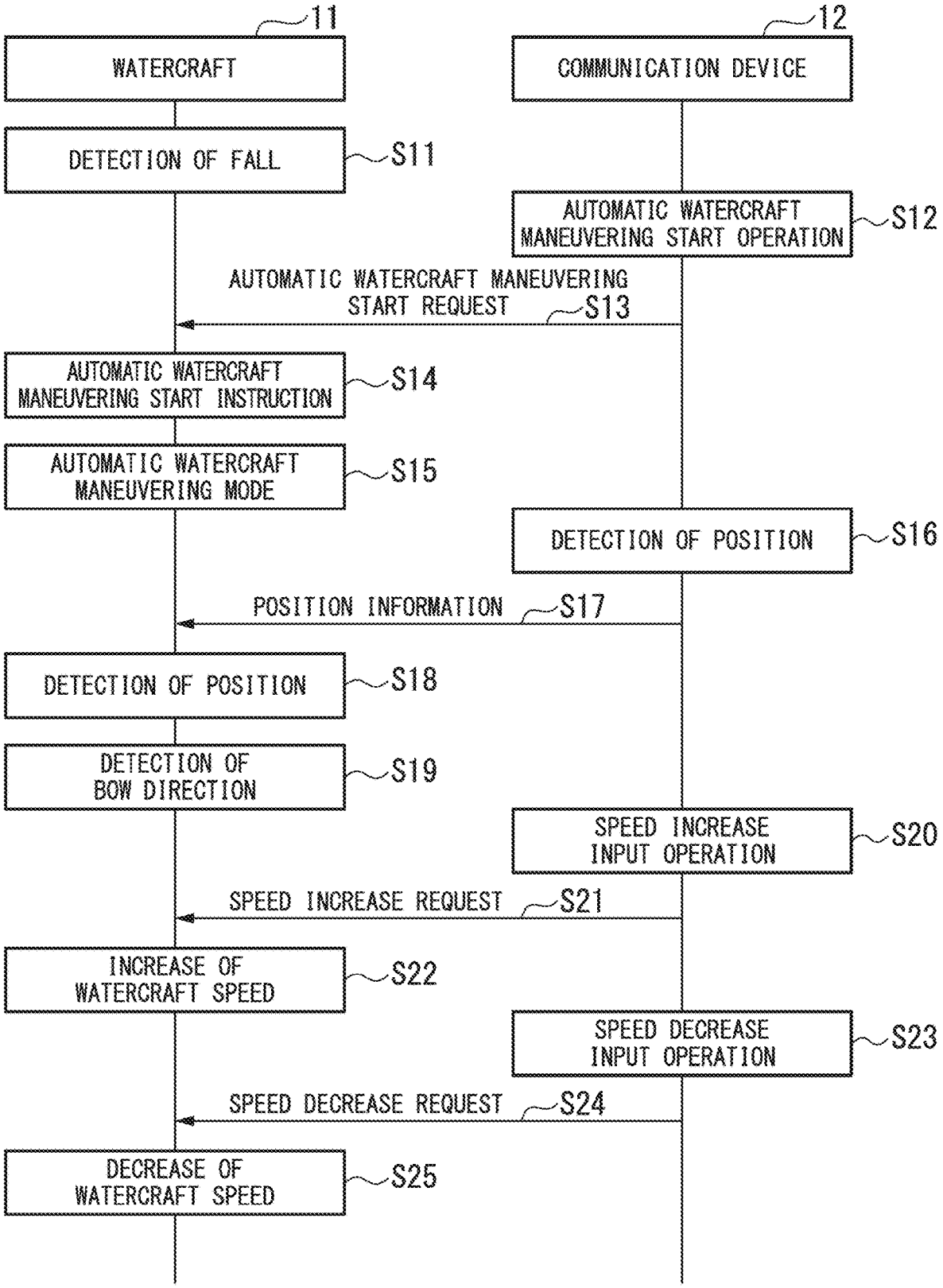
FIG. 4 is a sequence diagram explaining an example of a process which is performed in the automatic watercraft maneuvering system according to the first embodiment when a fall has been detected by a fall detecting unit of a watercraft.

FIG. 4 is a sequence diagram explaining an example of a process which is performed in the automatic watercraft maneuvering system 1 according to the first embodiment when a fall is detected by the fall detecting unit 11D1 of the watercraft 11.

In the example shown in FIG. 4, in Step S11, the fall detecting unit 11D1 of the watercraft 11 detects a fall of a passenger of the watercraft 11.

Subsequently, in Step S12, the automatic watercraft maneuvering start operating unit 12C1 of the communication device 12 receives an automatic watercraft maneuvering start request from an operator who carries the communication device 12 and fell off the watercraft 11.

Subsequently, in Step S13, the communication unit 12B of the communication device 12 transmits the automatic watercraft maneuvering start request received in Step S12, and the communication unit 11G of the watercraft 11 receives the automatic watercraft maneuvering start request.

Subsequently, in Step S14, the automatic watercraft maneuvering start instructing unit 11D2 of the watercraft 11 outputs an automatic watercraft maneuvering start instruction on the basis of the automatic watercraft maneuvering start request.

Subsequently, in Step S15, the watercraft control device 11C of the watercraft 11 switches to the automatic watercraft maneuvering mode in which the watercraft control device 11C operates the actuator 11A without the need for the operation unit 11B to receive an input operation.

Subsequently, in Step S16, the communication device position detecting unit 12A of the communication device 12 detects the position of the communication device 12.

Subsequently, in Step S17, the communication unit 12B of the communication device 12 transmits information indicating the position of the communication device 12 detected in Step S16, and the communication unit 11G of the watercraft 11 receives the information.

In Step S18, the watercraft position detecting unit 11E of the watercraft 11 detects the position of the watercraft 11.

In Step S19, the head direction detecting unit 11F of the watercraft 11 detects the head direction of the watercraft 11.

Subsequently, in Step S20, the speed increase switch 12C21 of the communication device 12 receives an input operation of increasing the speed of the watercraft 11. That is, the speed increase switch 12C21 receives a speed increase request of the watercraft 11.

Subsequently, in Step S21, the communication unit 12B of the communication device 12 transmits the speed increase request of the watercraft 11 received in Step S20, and the communication unit 11G of the watercraft 11 receives the speed increase request.

Subsequently, in Step S22, the watercraft control device 11C increases the speed of the watercraft 11 on the basis of the speed increase request.

Subsequently, in Step S23, the speed decrease switch 12C22 of the communication device 12 receives an input operation of decreasing the speed of the watercraft 11. That is, the speed decrease switch 12C22 receives a speed decrease request of the watercraft 11.

Subsequently, in Step S24, the communication unit 12B of the communication device 12 transmits the speed decrease request of the watercraft 11 received in Step S23, and the communication unit 11G of the watercraft 11 receives the speed decrease request.

Subsequently, in Step S25, the watercraft control device 11C decreases the speed of the watercraft 11 on the basis of the speed decrease request.

Second Embodiment

Hereinafter, an automatic watercraft maneuvering system, a watercraft control device, a watercraft control method, and a recording medium according to a second embodiment of the present disclosure will be described below.

The automatic watercraft maneuvering system 1 according to the second embodiment has the same configuration as the automatic watercraft maneuvering system 1 according to the first embodiment except for the following points. Accordingly, in the automatic watercraft maneuvering system 1 according to the second embodiment, it is possible to achieve the same advantages as in the automatic watercraft maneuvering system 1 according to the first embodiment, except for the following points.

Figure 5:
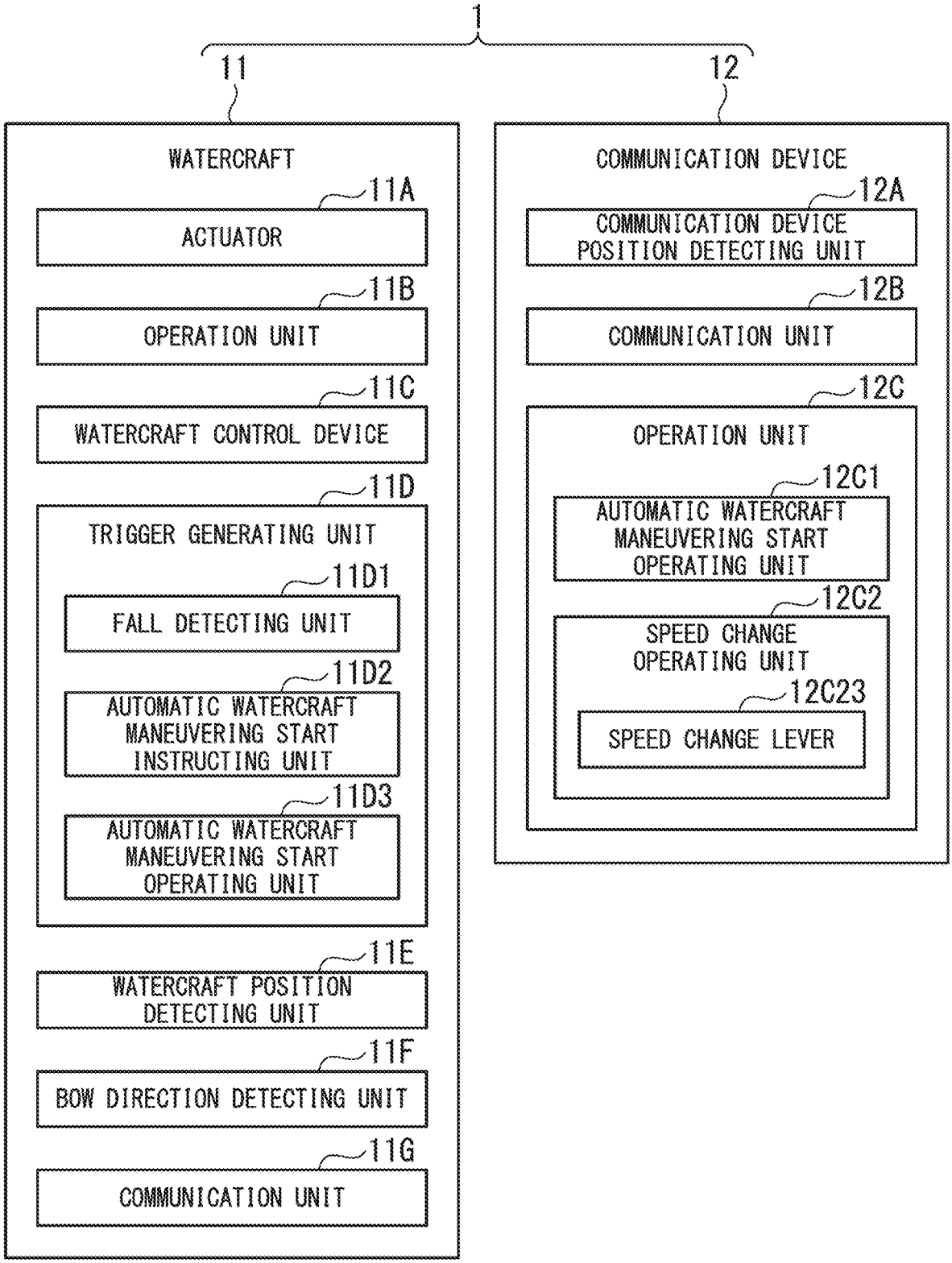
FIG. 5 is a diagram schematically showing an example of an automatic watercraft maneuvering system according to a second embodiment.

FIG. 5 is a diagram schematically showing an example of the automatic watercraft maneuvering system 1 according to the second embodiment.

In the example shown in FIG. 5, the automatic watercraft maneuvering system 1 includes a watercraft 11 having the same configuration as the watercraft 11 shown in FIG. 1 and a communication device 12.

The communication device 12 includes a communication device position detecting unit 12A having the same configuration as the communication device position detecting unit 12A shown in FIG. 1, a communication unit 12B having the same configuration as the communication unit 12B shown in FIG. 1, and an operation unit 12C.

The operation unit 12C includes an automatic watercraft maneuvering start operating unit 12C1 having the same configuration as the automatic watercraft maneuvering start operating unit 12C1 shown in FIG. 1 and a speed change operating unit 12C2.

The speed change operating unit 12C2 receives an input operation of changing the speed of the watercraft 11 in the automatic watercraft maneuvering mode of the watercraft control device 11C. The speed change operating unit 12C2 includes a speed change lever 12C23. The speed change lever 12C23 receives an input operation of increasing or decreasing the speed of the watercraft 11.

In the example shown in FIG. 5, the speed of the watercraft 11 is increased by a predetermined value when an input operation of increasing the speed of the watercraft 11 (for example, an operation of inclining the speed change lever 12C23 to a first side) is performed to the speed change lever 12C23 once, and the speed of the watercraft 11 is increased by N times the predetermined value when the input operation of increasing the speed of the watercraft 11 is performed to the speed change lever 12C23 N times. The speed of the watercraft 11 is decreased by a predetermined value when an input operation of decreasing the speed of the watercraft 11 (for example, an operation of inclining the speed change lever 12C23 to a second side which is opposite to the first side) is performed to the speed change lever 12C23 once, and the speed of the watercraft 11 is decreased by N times the predetermined value when the input operation of decreasing the speed of the watercraft 11 is performed to the speed change lever 12C23 N times.

That is, in the example shown in FIG. 5, the speed of the watercraft 11 is increased or decreased stepwise.

In another example, the speed of the watercraft 11 may be increased by a speed amount increase which is proportional to a time in which an input operation of increasing the speed of the watercraft 11 is performed to the speed change lever 12C23 (for example, a time in which the speed change lever 12C23 is inclined to the first side), and the speed of the watercraft 11 may be decreased by a speed decrease amount which is proportional to a time in which an input operation of decreasing the speed of the watercraft 11 is performed to the speed change lever 12C23 (for example, a time in which the speed change lever 12C23 is inclined to the second side).

That is, in this example, the speed of the watercraft 11 is increased or decreased stepless (linearly).

In the example shown in FIG. 5, the communication unit 12B transmits a speed change request (specifically, the speed increase request or the speed decrease request) of the watercraft 11 corresponding to the input operation received by the speed change operating unit 12C2 of the operation unit 12C to the watercraft 11. The communication unit 11G of the watercraft 11 receives the speed change request of the watercraft 11 transmitted by the communication unit 12B. The watercraft control device 11C controls the speed of the watercraft 11 on the basis of the speed change request transmitted from the communication device 12. That is, the watercraft control device 11C controls the speed of the watercraft 11 on the basis of the input operation received by the speed change operating unit 12C2 of the communication device 12.

In the automatic watercraft maneuvering system 1 according to the second embodiment, in a state in which the watercraft 11 is away from the communication device 12 (the fallen passenger) as shown in FIG. 2A, the fallen passenger performs an operation of making the watercraft 11 approach the position of the fallen passenger quickly.

Specifically, the speed change lever 12C23 of the communication device 12 receives an input operation of increasing the speed of the watercraft 11 from the fallen passenger. The speed increase request from the fallen passenger is transmitted to the watercraft 11 by the communication unit 12B of the communication device 12, and the watercraft control device 11C increases the speed of the watercraft 11 to V1 on the basis of the speed increase request from the fallen passenger.

In the automatic watercraft maneuvering system 1 according to the second embodiment, when the watercraft 11 approaches the communication device 12 (the fallen passenger) as shown in FIG. 2B, the fallen passenger performs an operation of decelerating or stopping the watercraft 11.

Specifically, the speed change lever 12C23 of the communication device 12 receives an input operation of decreasing the speed of the watercraft 11 from the fallen passenger. The speed decrease request from the fallen passenger is transmitted to the watercraft 11 by the communication unit 12B of the communication device 12, and the watercraft control device 11C decreases the speed of the watercraft 11 from V1 to V2 ($\approx 0$) on the basis of the speed decrease request from the fallen passenger.

That is, in the automatic watercraft maneuvering system 1 according to the second embodiment, the watercraft control device 11C of the watercraft 11 controls the speed of the watercraft 11 on the basis of the input operation received by the speed change lever 12C23 of the operation unit 12C of the communication device 12 when the watercraft control device 11C operates the actuator 11A to make the watercraft 11 approach the communication device 12 in the automatic watercraft maneuvering mode.

Accordingly, in the automatic watercraft maneuvering system 1 according to the second embodiment, it is possible to appropriately control the speed of the watercraft 11 in response to a request from an operator of the communication device 12 (a fallen passenger) in the automatic watercraft maneuvering mode.

Third Embodiment

Hereinafter, an automatic watercraft maneuvering system, a watercraft control device, a watercraft control method, and a recording medium according to a third embodiment of the present disclosure will be described below.

The automatic watercraft maneuvering system 1 according to the third embodiment has the same configuration as the automatic watercraft maneuvering system 1 according to the first embodiment except for the following points. Accordingly, in the automatic watercraft maneuvering system 1 according to the third embodiment, it is possible to achieve the same advantages as in the automatic watercraft maneuvering system 1 according to the first embodiment, except for the following points.

Figure 6:
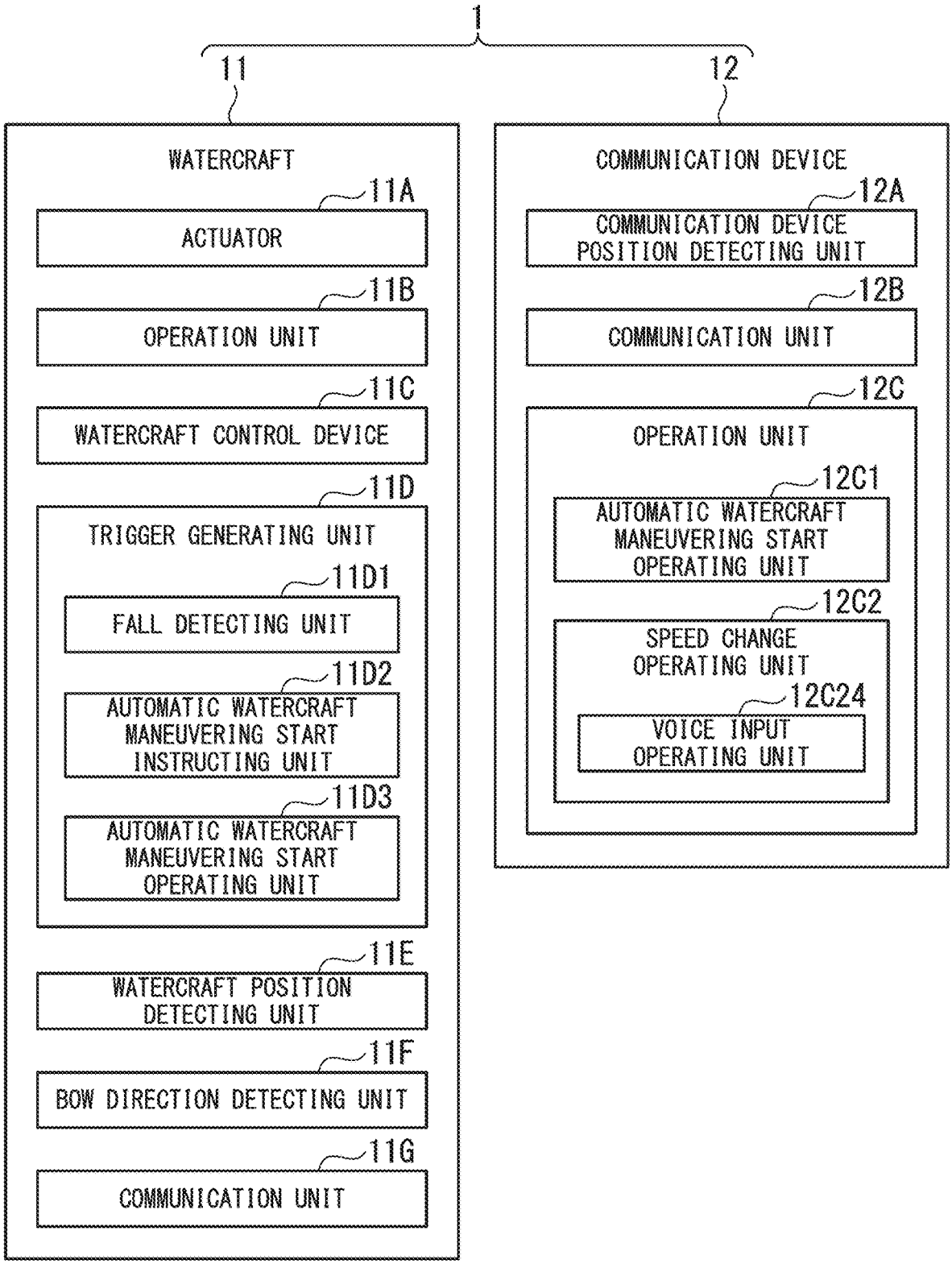
FIG. 6 is a diagram schematically showing an example of an automatic watercraft maneuvering system according to a third embodiment.

FIG. 6 is a diagram schematically showing an example of the automatic watercraft maneuvering system 1 according to the third embodiment.

In the example shown in FIG. 6, the automatic watercraft maneuvering system 1 includes a watercraft 11 having the same configuration as the watercraft 11 shown in FIG. 1 and a communication device 12.

The communication device 12 includes a communication device position detecting unit 12A having the same configuration as the communication device position detecting unit 12A shown in FIG. 1, a communication unit 12B having the same configuration as the communication unit 12B shown in FIG. 1, and an operation unit 12C.

The operation unit 12C includes an automatic watercraft maneuvering start operating unit 12C1 having the same configuration as the automatic watercraft maneuvering start operating unit 12C1 shown in FIG. 1 and a speed change operating unit 12C2.

The speed change operating unit 12C2 receives an input operation of changing the speed of the watercraft 11 in the automatic watercraft maneuvering mode of the watercraft control device 11C. The speed change operating unit 12C2 includes a voice input operating unit 12C24. The voice input operating unit 12C24 receives a voice input operation of increasing or decreasing the speed of the watercraft 11.

The voice input operating unit 12C24 receives a voice input operation of increasing or decreasing the speed of the watercraft 11 using the techniques described in, for example, Japanese Patent No. 5630275, Japanese Patent No. 5327838, etc. Specifically, the voice input operating unit 12C24 has a function of converting an input voice to text, a function of performing natural language analysis of text, and the like. In another example, the voice input operating unit 12C24 may receive a voice input operation of increasing or decreasing the speed of the watercraft 11 using a technique different from the aforementioned techniques.

In the example shown in FIG. 6, the communication unit 12B transmits a speed change request (specifically, the speed increase request or the speed decrease request) of the watercraft 11 corresponding to the input operation received by the speed change operating unit 12C2 of the operation unit 12C to the watercraft 11. The communication unit 11G of the watercraft 11 receives the speed change request of the watercraft 11 transmitted by the communication unit 12B. The watercraft control device 11C controls the speed of the watercraft 11 on the basis of the speed change request transmitted from the communication device 12. That is, the watercraft control device 11C controls the speed of the watercraft 11 on the basis of the input operation received by the speed change operating unit 12C2 of the communication device 12.

In the automatic watercraft maneuvering system 1 according to the third embodiment, in a state in which the watercraft 11 is away from the communication device 12 (the fallen passenger) as shown in FIG. 2A, the fallen passenger performs an operation of making the watercraft 11 approach the position of the fallen passenger quickly.

Specifically, the voice input operating unit 12C24 of the communication device 12 receives an input operation of increasing the speed of the watercraft 11 from the fallen passenger. The speed increase request from the fallen passenger is transmitted to the watercraft 11 by the communication unit 12B of the communication device 12, and the watercraft control device 11C increases the speed of the watercraft 11 to V1 on the basis of the speed increase request from the fallen passenger.

In the automatic watercraft maneuvering system 1 according to the third embodiment, when the watercraft 11 approaches the communication device 12 (the fallen passenger) as shown in FIG. 2B, the fallen passenger performs an operation of decelerating or stopping the watercraft 11.

Specifically, the voice input operating unit 12C24 of the communication device 12 receives an input operation of decreasing the speed of the watercraft 11 from the fallen passenger. The speed decrease request from the fallen passenger is transmitted to the watercraft 11 by the communication unit 12B of the communication device 12, and the watercraft control device 11C decreases the speed of the watercraft 11 from V1 to V2 ($\approx 0$) on the basis of the speed decrease request from the fallen passenger.

That is, in the automatic watercraft maneuvering system 1 according to the third embodiment, the watercraft control device 11C of the watercraft 11 controls the speed of the watercraft 11 on the basis of the input operation received by the voice input operating unit 12C24 of the operation unit 12C of the communication device 12 when the watercraft control device 11C operates the actuator 11A to make the watercraft 11 approach the communication device 12 in the automatic watercraft maneuvering mode.

Accordingly, in the automatic watercraft maneuvering system 1 according to the third embodiment, it is possible to appropriately control the speed of the watercraft 11 in response to a request from an operator of the communication device 12 (a fallen passenger) in the automatic watercraft maneuvering mode.

Fourth Embodiment

Hereinafter, an automatic watercraft maneuvering system, a watercraft control device, a watercraft control method, and a recording medium according to a fourth embodiment of the present disclosure will be described below.

The automatic watercraft maneuvering system 1 according to the fourth embodiment has the same configuration as the automatic watercraft maneuvering system 1 according to the first embodiment except for the following points. Accordingly, in the automatic watercraft maneuvering system 1 according to the fourth embodiment, it is possible to achieve the same advantages as in the automatic watercraft maneuvering system 1 according to the first embodiment, except for the following points.

Figure 7:
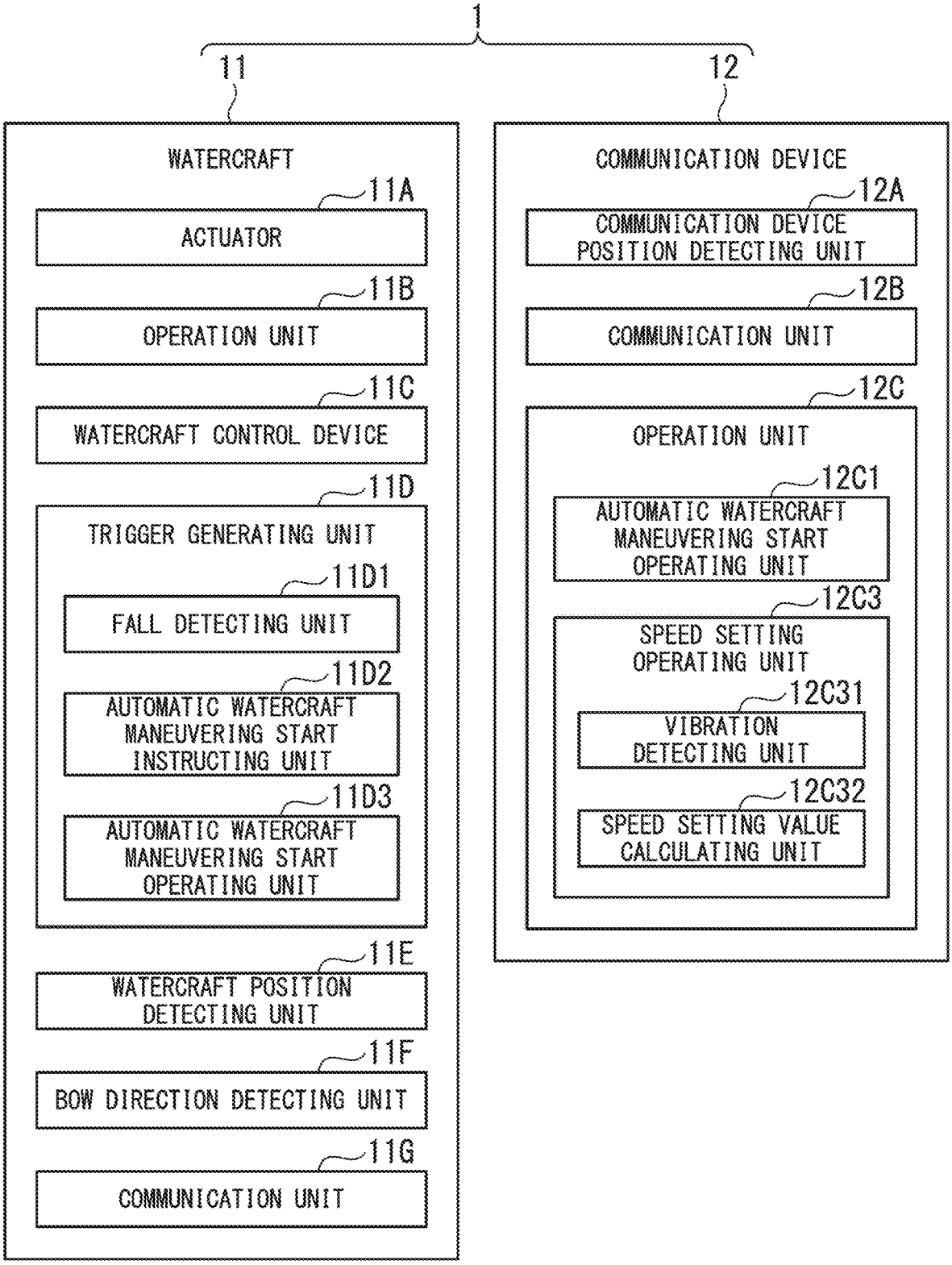
FIG. 7 is a diagram schematically showing an example of an automatic watercraft maneuvering system according to a fourth embodiment.

FIG. 7 is a diagram schematically showing an example of the automatic watercraft maneuvering system 1 according to the fourth embodiment.

In the example shown in FIG. 7, the automatic watercraft maneuvering system 1 includes a watercraft 11 having the same configuration as the watercraft 11 shown in FIG. 1 and a communication device 12.

The communication device 12 includes a communication device position detecting unit 12A having the same configuration as the communication device position detecting unit 12A shown in FIG. 1, a communication unit 12B having the same configuration as the communication unit 12B shown in FIG. 1, and an operation unit 12C.

The operation unit 12C includes an automatic watercraft maneuvering start operating unit 12C1 having the same configuration as the automatic watercraft maneuvering start operating unit 12C1 shown in FIG. 1 and a speed setting operating unit 12C3.

The speed setting operating unit 12C3 receives an input operation of setting the speed of the watercraft 11 in the automatic watercraft maneuvering mode of the watercraft control device 11C. The speed setting operating unit 12C3 includes a vibration detecting unit 12C31 and a speed setting value calculating unit 12C32.

The vibration detecting unit 12C31 detects vibration of the communication device 12. The vibration detecting unit 12C31 includes, for example, an acceleration sensor, a speed sensor, a displacement sensor, etc.

The speed setting value calculating unit 12C32 calculates a speed setting value of the watercraft 11 on the basis of a period or a frequency of the vibration of the communication device 12 detected by the vibration detecting unit 12C31.

For example, as the frequency of the vibration of the communication device 12 detected by the vibration detecting unit 12C31 becomes higher, the speed setting value calculating unit 12C32 calculates a greater value as the speed setting value of the watercraft 11. That is, the fallen passenger vibrates the communication device 12 at a high speed when the fallen passenger wants the watercraft 11 to move at a high speed. The fallen passenger vibrates the communication device 12 at a low speed when the fallen passenger wants the watercraft 11 to move at a low speed. The fallen passenger does not vibrate the communication device 12 when the fallen passenger wants the watercraft 11 to stop.

In the example shown in FIG. 7, the communication unit 12B transmits a speed setting request (specifically, a speed increase request, a speed maintaining request, or a speed decrease request) of the watercraft 11 corresponding to the input operation received by the speed setting operating unit 12C3 of the operation unit 12C to the watercraft 11. The communication unit 11G of the watercraft 11 receives the speed setting request of the watercraft 11 transmitted by the communication unit 12B. The watercraft control device 11C controls the speed of the watercraft 11 on the basis of the speed setting request transmitted from the communication device 12. That is, the watercraft control device 11C controls the speed of the watercraft 11 on the basis of the input operation received by the speed setting operating unit 12C3 of the communication device 12.

In the automatic watercraft maneuvering system 1 according to the fourth embodiment, in a state in which the watercraft 11 is away from the communication device 12 (the fallen passenger) as shown in FIG. 2A, the fallen passenger performs an operation of making the watercraft 11 approach the position of the fallen passenger quickly.

Specifically, the speed setting operating unit 12C3 of the communication device 12 receives an input operation of increasing the speed of the watercraft 11 (an input operation of setting the speed of the watercraft 11 to V1) from the fallen passenger. The speed increase request from the fallen passenger is transmitted to the watercraft 11 by the communication unit 12B of the communication device 12, and the watercraft control device 11C increases the speed of the watercraft 11 to V1 on the basis of the speed increase request from the fallen passenger.

In the automatic watercraft maneuvering system 1 according to the fourth embodiment, when the watercraft 11 approaches the communication device 12 (the fallen passenger) as shown in FIG. 2B, the fallen passenger performs an operation of decelerating or stopping the watercraft 11.

Specifically, the speed setting operating unit 12C3 of the communication device 12 receives an input operation of decreasing the speed of the watercraft 11 (an input operation of setting the speed of the watercraft 11 to V2) from the fallen passenger. The speed decrease request from the fallen passenger is transmitted to the watercraft 11 by the communication unit 12B of the communication device 12, and the watercraft control device 11C decreases the speed of the watercraft 11 from V1 to V2 (≈0) on the basis of the speed decrease request from the fallen passenger.

That is, in the automatic watercraft maneuvering system 1 according to the fourth embodiment, the watercraft control device 11C of the watercraft 11 controls the speed of the watercraft 11 on the basis of the input operation received by the speed setting operating unit 12C3 of the operation unit 12C of the communication device 12 when the watercraft control device 11C operates the actuator 11A to make the watercraft 11 approach the communication device 12 in the automatic watercraft maneuvering mode.

Accordingly, in the automatic watercraft maneuvering system 1 according to the fourth embodiment, it is possible to appropriately control the speed of the watercraft 11 in response to a request from an operator of the communication device 12 (a fallen passenger) in the automatic watercraft maneuvering mode.

Fifth Embodiment

Hereinafter, an automatic watercraft maneuvering system, a watercraft control device, a watercraft control method, and a recording medium according to a fifth embodiment of the present disclosure will be described below.

The automatic watercraft maneuvering system 1 according to the fifth embodiment has the same configuration as the automatic watercraft maneuvering system 1 according to the first embodiment except for the following points. Accordingly, in the automatic watercraft maneuvering system 1 according to the fifth embodiment, it is possible to achieve the same advantages as in the automatic watercraft maneuvering system 1 according to the first embodiment, except for the following points.

Figure 8:
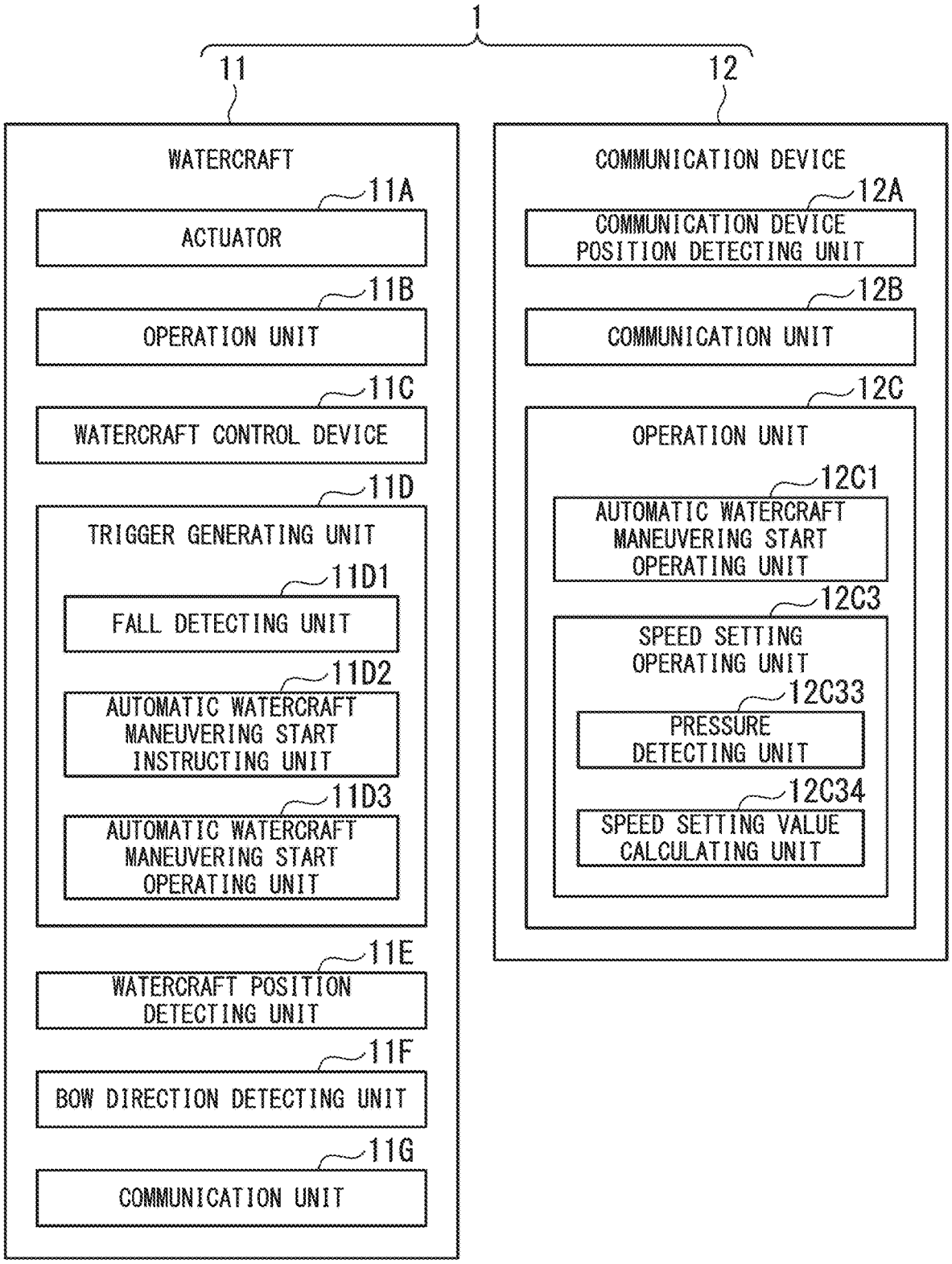
FIG. 8 is a diagram schematically showing an example of an automatic watercraft maneuvering system according to a fifth embodiment.

FIG. 8 is a diagram schematically showing an example of the automatic watercraft maneuvering system 1 according to the fifth embodiment.

In the example shown in FIG. 8, the automatic watercraft maneuvering system 1 includes a watercraft 11 having the same configuration as the watercraft 11 shown in FIG. 1 and a communication device 12.

The communication device 12 includes a communication device position detecting unit 12A having the same configuration as the communication device position detecting unit 12A shown in FIG. 1, a communication unit 12B having the same configuration as the communication unit 12B shown in FIG. 1, and an operation unit 12C.

The operation unit 12C includes an automatic watercraft maneuvering start operating unit 12C1 having the same configuration as the automatic watercraft maneuvering start operating unit 12C1 shown in FIG. 1 and a speed setting operating unit 12C3.

The speed setting operating unit 12C3 receives an input operation of setting the speed of the watercraft 11 in the automatic watercraft maneuvering mode of the watercraft control device 11C. The speed setting operating unit 12C3 includes a pressure detecting unit 12C33 and a speed setting value calculating unit 12C34.

The pressure detecting unit 12C33 detects a pressure applied to the communication device 12. The pressure detecting unit 12C33 includes, for example, a load sensor, a distortion gauge, a distributed pressure sensor, etc., and detects a pressure applied to the communication device 12 (that is, a pressure applied to the communication device 12 held by the fallen passenger) using the same techniques as described in, for example, Japanese Patent No. 5391695, Japanese Patent No. 4956964, etc.

The speed setting value calculating unit 12C34 calculates a speed setting value of the watercraft 11 on the basis of the pressure applied to the communication device 12 which is detected by the pressure detecting unit 12C33.

For example, as the pressure applied to the communication device 12 detected by the pressure detecting unit 12C33 becomes higher, the speed setting value calculating unit 12C34 calculates a greater value as the speed setting value of the watercraft 11. That is, the fallen passenger holds the communication device 12 with a large force when the fallen passenger wants the watercraft 11 to move at a high speed. The fallen passenger holds the communication device 12 with a small force when the fallen passenger wants the watercraft 11 to move at a low speed. The fallen passenger does not hold the communication device 12 but puts the communication device 12 on a palm or the like when the fallen passenger wants the watercraft 11 to stop.

In the example shown in FIG. 8, the communication unit 12B transmits a speed setting request (specifically, a speed increase request, a speed maintaining request, or a speed decrease request) of the watercraft 11 corresponding to the input operation received by the speed setting operating unit 12C3 of the operation unit 12C to the watercraft 11. The communication unit 11G of the watercraft 11 receives the speed setting request of the watercraft 11 transmitted by the communication unit 12B. The watercraft control device 11C controls the speed of the watercraft 11 on the basis of the speed setting request transmitted from the communication device 12. That is, the watercraft control device 11C controls the speed of the watercraft 11 on the basis of the input operation received by the speed setting operating unit 12C3 of the communication device 12.

In the automatic watercraft maneuvering system 1 according to the fifth embodiment, in a state in which the watercraft 11 is away from the communication device 12 (the fallen passenger) as shown in FIG. 2A, the fallen passenger performs an operation of making the watercraft 11 approach the position of the fallen passenger quickly.

Specifically, the speed setting operating unit 12C3 of the communication device 12 receives an input operation of increasing the speed of the watercraft 11 (an input operation of setting the speed of the watercraft 11 to V1) from the fallen passenger. The speed increase request from the fallen passenger is transmitted to the watercraft 11 by the communication unit 12B of the communication device 12, and the watercraft control device 11C increases the speed of the watercraft 11 to V1 on the basis of the speed increase request from the fallen passenger.

In the automatic watercraft maneuvering system 1 according to the fifth embodiment, when the watercraft 11 approaches the communication device 12 (the fallen passenger) as shown in FIG. 2B, the fallen passenger performs an operation of decelerating or stopping the watercraft 11.

Specifically, the speed setting operating unit 12C3 of the communication device 12 receives an input operation of decreasing the speed of the watercraft 11 (an input operation of setting the speed of the watercraft 11 to V2) from the fallen passenger. The speed decrease request from the fallen passenger is transmitted to the watercraft 11 by the communication unit 12B of the communication device 12, and the watercraft control device 11C decreases the speed of the watercraft 11 from V1 to V2 ($\approx 0$) on the basis of the speed decrease request from the fallen passenger.

That is, in the automatic watercraft maneuvering system 1 according to the fifth embodiment, the watercraft control device 11C of the watercraft 11 controls the speed of the watercraft 11 on the basis of the input operation received by the speed setting operating unit 12C3 of the operation unit 12C of the communication device 12 when the watercraft control device 11C operates the actuator 11A to make the watercraft 11 approach the communication device 12 in the automatic watercraft maneuvering mode.

Accordingly, in the automatic watercraft maneuvering system 1 according to the fifth embodiment, it is possible to appropriately control the speed of the watercraft 11 in response to a request from an operator of the communication device 12 (a fallen passenger) in the automatic watercraft maneuvering mode.

Sixth Embodiment

Hereinafter, an automatic watercraft maneuvering system, a watercraft control device, a watercraft control method, and a recording medium according to a sixth embodiment of the present disclosure will be described below.

The automatic watercraft maneuvering system 1 according to the sixth embodiment has the same configuration as the automatic watercraft maneuvering system 1 according to the first embodiment except for the following points. Accordingly, in the automatic watercraft maneuvering system 1 according to the sixth embodiment, it is possible to achieve the same advantages as in the automatic watercraft maneuvering system 1 according to the first to fifth embodiments, except for the following points.

As described above, the watercraft 11 in the first to fifth embodiments is a personal watercraft (PWC) having the same function as a function of a PWC (a water-motorcycle) described in, for example, FIG. 1 of Japanese Patent No. 5196649.

On the other hand, the watercraft 11 in the sixth embodiment is a watercraft having the same function as a function of a watercraft described in, for example, FIG. 1 of Japanese Patent No. 6198192.

An actuator 11A of the watercraft 11 according to the sixth embodiment has a function of generating thrust of the watercraft 11 and a function as a steering unit. The actuator 11A includes an outboard unit, an engine, an actuator, a shift mechanism, etc., described in, for example, FIG. 1 of Japanese Patent No. 6198192.

An operation unit 11B of the watercraft 11 according to the sixth embodiment receives an input operation of an operator who operates the actuator 11A. The operation unit 11B includes a steering wheel, a remote controller, an operation lever, etc., described in, for example, FIG. 1 of Japanese Patent No. 6198192. The operation unit 11B of the watercraft 11 according to the sixth embodiment may include, for example, a joystick, etc.

While preferred embodiments of the present disclosure have been described and illustrated above, it should be understood that these are exemplary of the invention and are not to be considered as limiting. Additions, omissions, substitutions, and other modifications can be made without departing from the spirit or scope of the present disclosure. Accordingly, the present disclosure is not to be considered as being limited by the foregoing description and is only limited by the scope of the appended claims.

All or some of the functions of the constituents of the automatic watercraft maneuvering system 1 according to the aforementioned embodiments may be realized by recording a program for realizing the functions on a computer-readable recording medium and causing a computer system to read and execute the program recorded on the recording medium. The "computer system" mentioned herein may include an operating system (OS) or hardware such as peripherals.

The "computer-readable recording medium" may be a portable medium such as a flexible disk, a magneto-optical disc, a ROM, or a CD-ROM or a storage unit such as a hard disk incorporated in a computer system. The "computer-readable recording medium" may include a medium that dynamically holds a program for a short time like a communication line in a case in which a program is transmitted via a network such as the Internet or a communication circuit line such as a telephone line or a medium that holds a program for a predetermined time such as a volatile memory in a computer system serving as a server or a client in that case. The program may be a program for realizing some of the aforementioned functions or may be a program which can realize the aforementioned functions in combination with another program stored in advance in the computer system.

EXPLANATION OF REFERENCES

1 Automatic watercraft maneuvering system
11 Watercraft
11A Actuator
11B Operation unit
11C Watercraft control device
11D Trigger generating unit
11D1 Fall detecting unit

11D2 Automatic watercraft maneuvering start instructing unit
11D3 Automatic watercraft maneuvering start operating unit
11E Watercraft position detecting unit
11F Head direction detecting unit
11G Communication unit
12 Communication device
12A Communication device position detecting unit
12B Communication unit
12C Operation unit
12C1 Automatic watercraft maneuvering start operating unit
12C2 Speed change operating unit
12C21 Speed increase switch
12C22 Speed decrease switch
12C23 Speed change lever
12C24 Voice input operating unit
12C3 Speed setting operating unit
12C31 Vibration detecting unit
12C32 Set speed value calculating unit
12C33 Pressure detecting unit
12C34 Set speed value calculating unit

What is claimed is:

1. An automatic watercraft maneuvering system comprising a watercraft and a communication device,
wherein the watercraft includes:
an actuator having a function of generating thrust of the watercraft and a function as a steering unit;
a first operation unit configured to receive an input operation of operating the actuator; and
a watercraft control device configured to operate the actuator on the basis of at least the input operation received by the first operation unit,
wherein the watercraft control device includes a manual watercraft maneuvering mode in which the watercraft control device operates the actuator on the basis of the input operation received by the first operation unit and an automatic watercraft maneuvering mode in which the watercraft control device operates the actuator without the need for the first operation unit to receive an input operation,
wherein the communication device includes a speed change operating unit configured to receive an input operation of changing or setting a speed of the watercraft in a state in which the watercraft is away from the communication device, and
wherein the watercraft control device controls a speed of the watercraft on the basis of the input operation received by the speed change operation unit when the watercraft control device operates the actuator to make the watercraft approach the communication device in the automatic watercraft maneuvering mode,
wherein the speed change operating unit includes a speed change lever configured to receive an input operation of increasing or decreasing the speed of the watercraft.

2. An automatic watercraft maneuvering system comprising a watercraft and a communication device,
wherein the watercraft includes:
an actuator having a function of generating thrust of the watercraft and a function as a steering unit;
a first operation unit configured to receive an input operation of operating the actuator; and
a watercraft control device configured to operate the actuator on the basis of at least the input operation received by the first operation unit,
wherein the watercraft control device includes a manual watercraft maneuvering mode in which the watercraft control device operates the actuator on the basis of the input operation received by the first operation unit and an automatic watercraft maneuvering mode in which the watercraft control device operates the actuator without the need for the first operation unit to receive an input operation,
wherein the communication device includes a speed change operating unit configured to receive an input operation of changing or setting a speed of the watercraft in a state in which the watercraft is away from the communication device, and
wherein the watercraft control device controls a speed of the watercraft on the basis of the input operation received by the speed change operation unit when the watercraft control device operates the actuator to make the watercraft approach the communication device in the automatic watercraft maneuvering mode,
wherein the speed change operating unit includes a voice input operating unit configured to receive a voice input operation of increasing or decreasing the speed of the watercraft.

3. An automatic watercraft maneuvering system comprising a watercraft and a communication device,
wherein the watercraft includes:
an actuator having a function of generating thrust of the watercraft and a function as a steering unit;
a first operation unit configured to receive an input operation of operating the actuator; and
a watercraft control device configured to operate the actuator on the basis of at least the input operation received by the first operation unit,
wherein the watercraft control device includes a manual watercraft maneuvering mode in which the watercraft control device operates the actuator on the basis of the input operation received by the first operation unit and an automatic watercraft maneuvering mode in which the watercraft control device operates the actuator without the need for the first operation unit to receive an input operation,
wherein the communication device includes a speed change operating unit configured to receive an input operation of changing or setting a speed of the watercraft in a state in which the watercraft is away from the communication device, and
wherein the watercraft control device controls a speed of the watercraft on the basis of the input operation received by the speed change operation unit when the watercraft control device operates the actuator to make the watercraft approach the communication device in the automatic watercraft maneuvering mode,
wherein the speed change operating unit configured to receive a speed setting operation of the watercraft includes:
a vibration detecting unit configured to detect vibration of the communication device; and
a speed setting value calculating unit configured to calculate a speed setting value of the watercraft on the basis of a period or a frequency of the vibration of the communication device detected by the vibration detecting unit.

4. An automatic watercraft maneuvering system comprising a watercraft and a communication device,
wherein the watercraft includes:
an actuator having a function of generating thrust of the watercraft and a function as a steering unit;

a first operation unit configured to receive an input operation of operating the actuator; and a watercraft control device configured to operate the actuator on the basis of at least the input operation received by the first operation unit, wherein the watercraft control device includes a manual watercraft maneuvering mode in which the watercraft control device operates the actuator on the basis of the input operation received by the first operation unit and an automatic watercraft maneuvering mode in which the watercraft control device operates the actuator without the need for the first operation unit to receive an input operation, wherein the communication device includes a speed change operating unit configured to receive an input operation of changing or setting a speed of the watercraft in a state in which the watercraft is away from the communication device, and wherein the watercraft control device controls a speed of the watercraft on the basis of the input operation received by the speed change operation unit when the watercraft control device operates the actuator to make the watercraft approach the communication device in the automatic watercraft maneuvering mode, wherein the speed change operating unit configured to receive a speed setting operation of the watercraft includes:

a pressure detecting unit configured to detect a pressure applied to the communication device; and a speed setting value calculating unit configured to calculate a speed setting value of the watercraft on the basis of the pressure applied to the communication device detected by the pressure detecting unit.

5. A watercraft capable of communicating with a communication device, the watercraft comprising;

an actuator having a function of generating thrust of the watercraft and a function as a steering unit;

a first operation unit configured to receive an input operation of operating the actuator; and a watercraft control device configured to operate the actuator on the basis of at least the input operation received by the first operation unit, wherein the watercraft control device includes a manual watercraft maneuvering mode in which the watercraft control device operates the actuator on the basis of the input operation received by the first operation unit and an automatic watercraft maneuvering mode in which the watercraft control device operates the actuator without the need for the first operation unit to receive an input operation, and wherein the watercraft control device controls a speed of the watercraft on the basis of an input operation received by a speed change lever as a speed change operating unit configured to receive an input operation of increasing or decreasing the speed of the watercraft provided in the communication device when the watercraft control device operates the actuator to make the watercraft approach the communication device in the automatic watercraft maneuvering mode in a state in which the watercraft is away from the communication device in a state in which the watercraft is away from the communication device.

* * * * *